US012535237B2

(12) United States Patent
Liu

(10) Patent No.: US 12,535,237 B2
(45) Date of Patent: Jan. 27, 2026

(54) SYSTEM AND METHOD FOR CONTROLLING A MULTI-ZONE DUAL DECK AIR HANDLING UNIT

(71) Applicant: Siemens Industry, Inc., Alpharetta, GA (US)

(72) Inventor: Jibo Liu, Long Grove, IL (US)

(73) Assignee: Siemens Industry, Inc., Alpharetta, GA (US)

( * ) Notice: Subject to any disclaimer, the term of this patent is extended or adjusted under 35 U.S.C. 154(b) by 624 days.

(21) Appl. No.: 17/812,624

(22) Filed: Jul. 14, 2022

(65) Prior Publication Data

US 2024/0019153 A1 Jan. 18, 2024

(51) Int. Cl.

| | |
|---|---|
| ***F24F 11/63*** | (2018.01) |
| ***F24F 3/00*** | (2006.01) |
| ***F24F 11/46*** | (2018.01) |
| ***F24F 11/65*** | (2018.01) |
| ***F24F 11/74*** | (2018.01) |
| ***F24F 110/12*** | (2018.01) |
| ***F24F 140/40*** | (2018.01) |

(52) U.S. Cl.

CPC ..... *F24F 11/46* (2018.01); *F24F 11/63* (2018.01); *F24F 11/65* (2018.01); *F24F 11/74* (2018.01); *F24F 2003/006* (2013.01); *F24F 2110/12* (2018.01); *F24F 2140/40* (2018.01); *F24F 2221/54* (2013.01)

(58) Field of Classification Search

CPC .. F24F 11/63; F24F 11/74; F24F 3/001; F24F 3/065; F24F 2003/006; F24F 2110/12; F24F 2140/40; F24F 2221/54; F24F 11/65; F24F 11/46

See application file for complete search history.

(56) References Cited

U.S. PATENT DOCUMENTS

| | | | | |
|---|---|---|---|---|
| 4,947,928 | A | 8/1990 | Parker et al. | |
| 5,407,002 | A | 4/1995 | Voll | |
| 2007/0037507 | A1* | 2/2007 | Liu | F24F 11/77 454/229 |

(Continued)

FOREIGN PATENT DOCUMENTS

CA 2123173 A1 11/1995

OTHER PUBLICATIONS

York Application of Soution Units, Application Guide, Form: 102. 20-AG12 (307), Supersedes: 1022020-AG12(206), Johnson Controls 2006, 8 pages.

*Primary Examiner* — Rami R Okasha

(57) ABSTRACT

There is disclosed a system and method for controlling a multi-zone dual deck air handling unit. An outside air temperature of the air handling unit is received. Zone demands associated with zones are received in which each zone demand corresponds to a particular zone. A cooling deck of the air handling unit, a heating deck of the air handling unit, or both, are engaged in response to the outside air temperature and the plurality of zone demands. Zone dampers associated with the zones are positioned based on the zone demands in response to engaging the cooling deck and the heating deck concurrently. Each zone damper is position at either a maximum cooling position or a maximum heating position. The zone dampers associated with the zones are modulated based on the zone demands in response to engaging the cooling deck or the heating deck distinctly.

16 Claims, 6 Drawing Sheets

(56) References Cited

U.S. PATENT DOCUMENTS

| | | | | |
|---|---|---|---|---|
| 2014/0277766 | A1* | 9/2014 | Yarde | F24F 11/70<br>700/277 |
| 2019/0301758 | A1* | 10/2019 | Johnston | F24F 8/167 |
| 2019/0353383 | A1* | 11/2019 | McCune | F24F 11/74 |
| 2020/0284463 | A1* | 9/2020 | Atchison | F24F 11/79 |
| 2024/0085047 | A1* | 3/2024 | Woolaway | F24F 11/63 |

* cited by examiner

SYSTEM AND METHOD FOR CONTROLLING A MULTI-ZONE DUAL DECK AIR HANDLING UNIT

FIELD OF THE INVENTION

This application relates to the field of air handling units for buildings and, more particularly, to systems and methods for controlling multi-zone dual deck air handling units.

BACKGROUND

An HVAC can provide comfort to the occupants of a building by supplying both cooled and/or heated air throughout a facility. The HVAC includes an air handling unit (AHU) to handle ventilation of cooled and cooled air for various zones of the facility. Some AHUs are dual deck air handling units that include a heated air deck and cooled air deck. Some systems mix the heated and cooled airflows together at the air handling unit, and the mixed air is transferred via ducts to each zone by dampers. Other systems transfer hot and cold air to each zone and mix them together at the zone in a variable air volume (VAV) box of the ducts. A dual deck air handling units may be highly flexible and service diverse loads for multiple zones.

The multi-zone dual deck air handling unit can provide cold air, hot air, or both to one or more zones of the building and meet the demands of the individual zones. When these types of units engages both cooling and heating concurrently, their energy efficiency may be compromised since cold and hot air may cancel each other out. The mixing of cold air and hot air at the decks or in the ducts result in energy waste when by cooling and heating are engaged simultaneously.

SUMMARY

In accordance with one embodiment of the disclosure, there is provided a holistic approach for a building management system. The approach addresses the energy waste in a dual deck air handling unit while maintaining comfort of occupants of a facility.

One aspect is a system for controlling a multi-zone dual deck air handling unit comprising an input component, an output component, and a processor. The input component receives an outside air temperature of the air handling unit and zone demands associated with zones. Each zone demand corresponds to a particular zone. The output component communicates with zone dampers and a cooling deck of the air handling unit, a heating deck of the air handling unit, or both. The processor directs the output component to engage the cooling deck, the heating deck, or both, in response to the outside air temperature and the demands. The processor directs the output component to position zone dampers associated with the zones based on the zone demands in response to engaging the cooling deck and the heating deck concurrently. Each zone damper is positioned at either a maximum cooling position or a maximum heating position. The processor directs the output component to modulate the zone dampers associated with the zones based on the zone demands in response to engaging the cooling deck or the heating deck distinctly.

Another aspect is a method for controlling a multi-zone dual deck air handling unit. An outside air temperature of the air handling unit is received. Zone demands associated with zones are received in which each zone demand corresponds to a particular zone. A cooling deck of the air handling unit, a heating deck of the air handling unit, or both, are engaged in response to the outside air temperature and the plurality of zone demands. Zone dampers associated with the zones are positioned based on the zone demands in response to engaging the cooling deck and the heating deck concurrently. Each zone damper is position at either a maximum cooling position or a maximum heating position. The zone dampers associated with the zones are modulated based on the zone demands in response to engaging the cooling deck or the heating deck distinctly.

The above described features and advantages, as well as others, will become more readily apparent to those of ordinary skill in the art by reference to the following detailed description and accompanying drawings. While it would be desirable to provide one or more of these or other advantageous features, the teachings disclosed herein extend to those embodiments which fall within the scope of the appended claims, regardless of whether they accomplish one or more of the above-mentioned advantages.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects.

DETAILED DESCRIPTION

Figure 1:
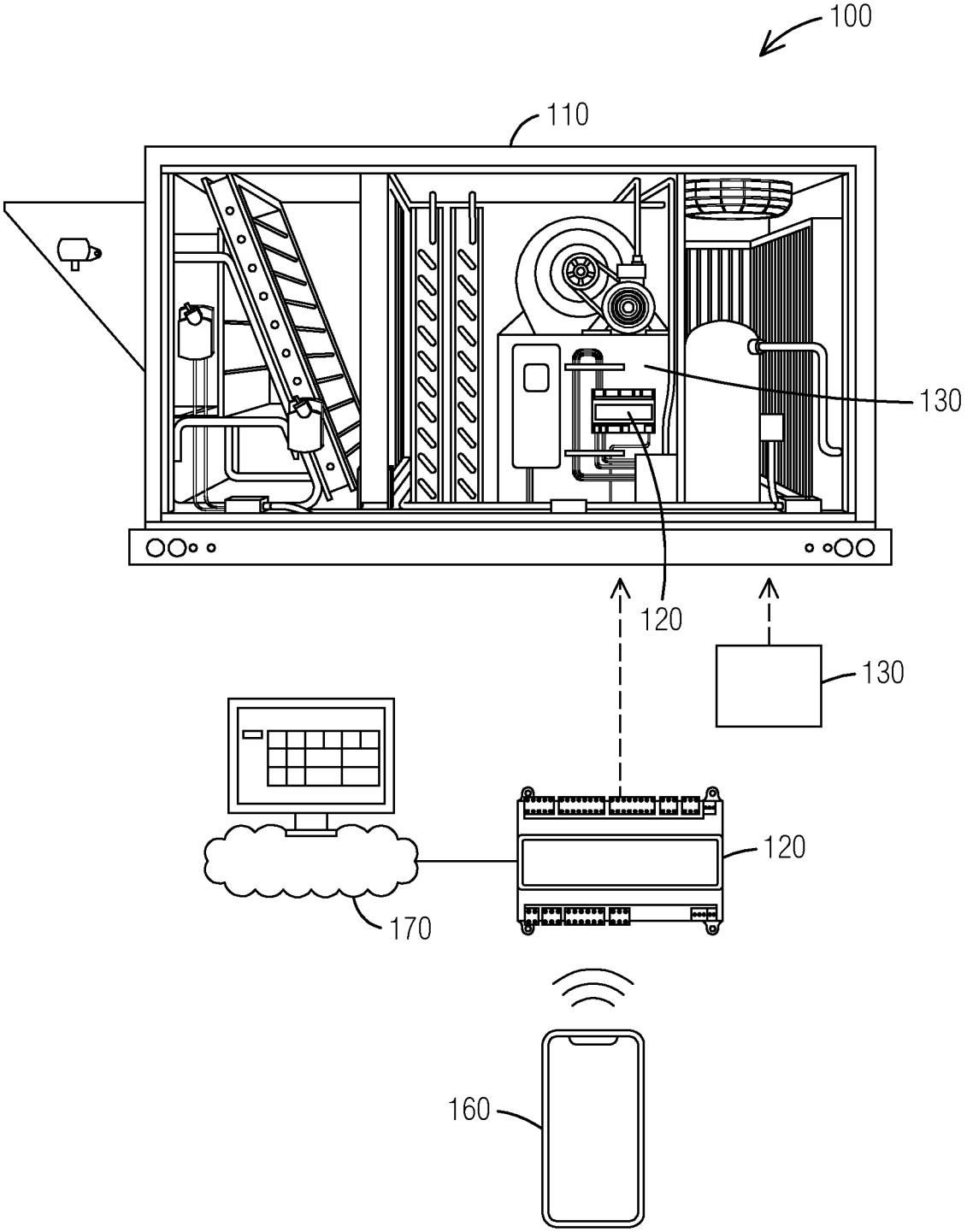
FIG. 1 is a side planar view of a rooftop unit ("RTU") in an example implementation that is operable to employ techniques described herein.

Various technologies that pertain to systems and methods that facilitate holistic system monitoring will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

The holistic system addresses the energy efficiency of dual deck rooftop unit while meeting the comfort needs of occupants. The heating deck/cooling deck management technique of the system provides configurations of controls to minimize simultaneous heating and cooling. For the system, ambient lockout and zone demand are used to engage cooling and heating functions. Loads of the system are shifted to further reduce the chance running both cooling and heating at the same time. System control of individual zones may be switched to energy efficient modes to reduce or eliminate the mixing of cold air and hot air. In addition, zone control may be fully integrated with cooling and heating functions to reset capacity demand, engagement, and disengagement of cooling and heating functions. In contrast to conventional multi-zone dual deck systems, the system described herein considers energy efficiency as well as occupant comfort for its operations. Accordingly, a substantial reduction of the energy waste may be achieved for a neutral zone, where both cooling and heating engage simultaneously, with no or minimum hardware investment.

Referring to FIG. 1, there is shown an illustration of an environmental control system 100 in an example implementation that is operable to employ techniques described herein. An environmental control system 100 of a building manages components of an air handling unit (AHU), such as a rooftop unit (RTU) 110, to control environmental conditions within the building. The rooftop unit 110 may allow fresh air external to the building and/or return air internal to the building to circulate through the RTU components and cool the environmental conditions of the building in an efficient manner. A logic controller 120 of the rooftop unit 110 operates in conjunction with other RTU components to provide operational control for the system 100, such as configuring, commissioning, troubleshooting, and other control functions. The RTU components of the rooftop unit 110 includes heating and/or cooling coils that modify, if necessary, the temperature of return air to generate supply air for the building.

The logic controller 120 operates with other RTU components to commission, troubleshoot, and otherwise operate the environmental control system 100. In particular, the rooftop unit 110 may include a dual deck mechanism 130, explained in detail in reference to FIG. 3 below, to manage operation and efficiency of air flow throughout the air handling unit. The system 100 also includes a mobile device 160 to support a mobile application and control the logic controller 120, and/or a cloud device 170 to provide additional functions to the logic controller, such as multi-site monitoring, fault detections & diagnostics, and alarm functions.

Figure 2:
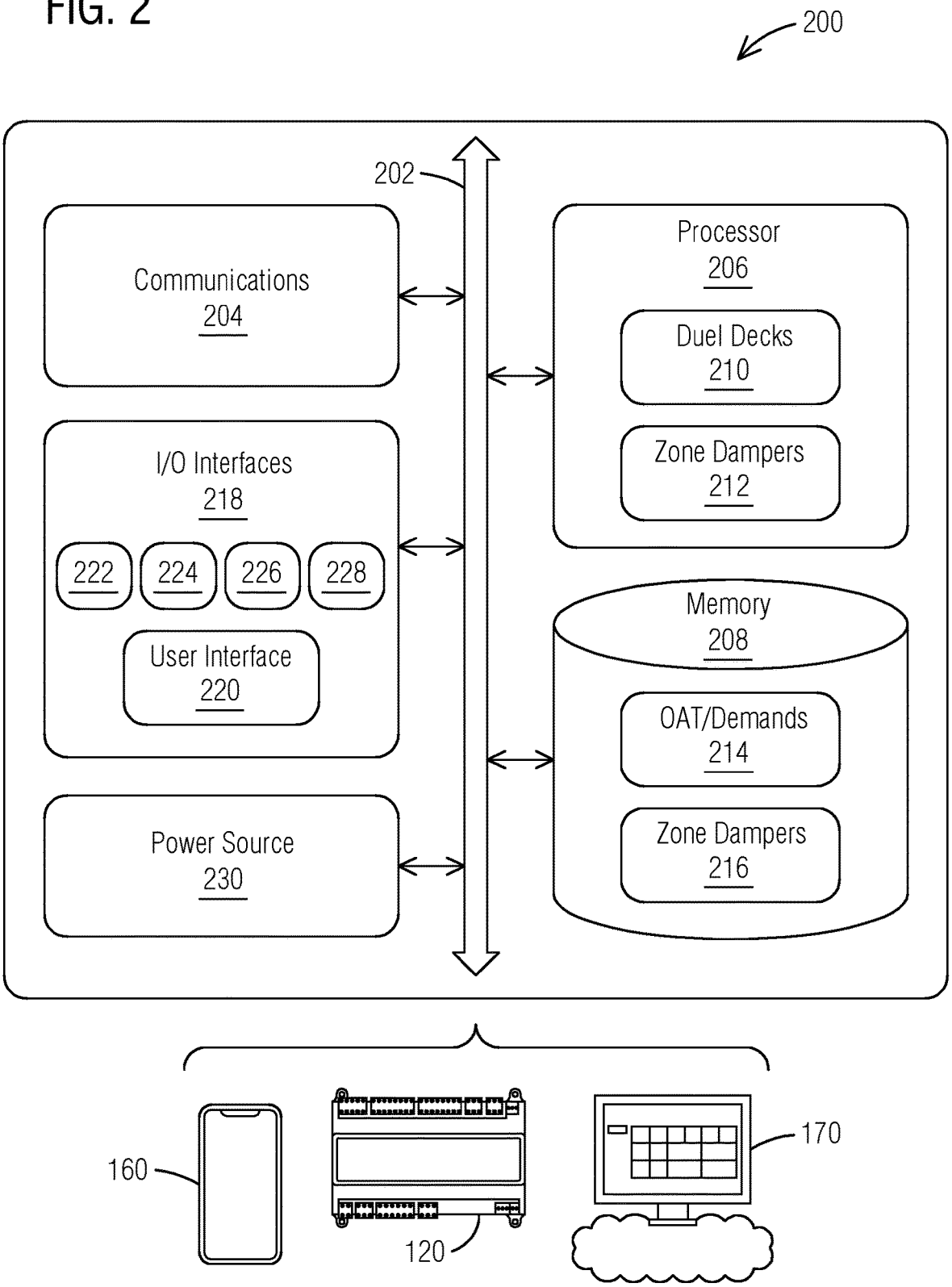
FIG. 2 is a block diagram of system components of an air handling unit ("AHU"), such as the RTU of FIG. 1, in an example implementation.

Referring to FIG. 2, there is shown system components of the control device 200 for the air handling unit ("AHU") in an example implementation. Examples of the control device 200 include, but are not limited to, the logic controller 120, the mobile device 160, or the cloud device 170, of the environmental control system 100. The control device 200 may be any type of configuring, commissioning, troubleshooting, or other type of control device for operation of the various components of the environmental control system 100. The control device 200 includes a communication bus 202 for interconnecting the other device components directly or indirectly, one or more communication components 204 communicating other entities via a wired and/or wireless network, one or more processors 206, and one or more memory components 208.

The communication component 204 may utilize wireless technology for communication, such as, but are not limited to, cellular-based communications, Bluetooth (including BLE), ultrawide band (UWB), Wi-Fi (including Wi-Fi Direct), IEEE 802.15.4, Z-Wave, 6LoWPAN, Near-Field Communication, other types of electromagnetic radiation of a radio frequency wave, light-based communications (including infrared), acoustic communications, and any other type of peer-to-peer technology. The communication component 204 of the control device 200 may also utilize wired technology for communication, such as transmission of data over a physical conduit, e.g., an electrical cable or optical fiber cable.

The one or more processors 206 may execute code and process data received at other components of the control device 200, such as information received at the communication component 204 or stored at the memory component 208. The code associated with the environmental control system 100 and stored by the memory component 208 may include, but is not limited to, operating systems, applications, modules, drivers, and the like. An operating system includes executable code that controls basic functions of the control device 200, such as interactions among the various components of the control device, communication with external devices via the communication component 204, and storage and retrieval of code and data to and from the memory component 208.

Each application includes executable code to provide specific functionality for the processor 206 and/or remaining components of the control device 200. Examples of applications executable by the processor 206 include, but are not limited to, a dual deck control module 210 for determining engagement of one or both of the cooling and heating decks in response to the outside air temperature and the plurality of zone demands, and a zone dampers control module 212 for determining the positioning of the zone dampers at maximum positions or the modulation of the zone dampers when engaging the cooling or heating decks distinctly.

Data is information that may be referenced and/or manipulated by an operating system or application for performing functions of the control device 200. Examples of data associated with control device operations and stored by the memory component 208 may include, but are not limited to, outside air temperature (OAT) and zone demand data 214 received by various input components of the system 100, and positioning and modulating data 216 for the zone dampers based on the zone demands and other considerations.

The control device 200 may further include one or more input and/or output components 218 ("I/O interfaces"). A user interface 220 of the control device 200 may include portions of the input and/or output components 218 and be used to interact with a user of the control device. For example, the user interface 220 may include a combination of hardware and software to provide a user with a desired user experience.

The input and output components 218 may include other components 222-228 to facilitate operations of the system 100, such as outside air temperature sensors 222, user control devices 224, cooling and heating deck connections 226, damper connections 228, and the like. For example, the input components may include one or more sensors to receive an outside air temperature of the air handling unit and one or more user control devices to receive zone demands associated with zones. Likewise, the output components may include connections for communication with the zone dampers and the cooling and heating decks the air handling unit.

The control device 200 may further include a power source 230, such as a power supply or a portable battery, for providing power to the other device components of the control device 200.

It is to be understood that FIG. 2 is provided for illustrative purposes only to represent examples of the internal components of the control device 200 and is not intended to be a complete diagram of the various components that may be utilized by the device. Therefore, the control device 200 may include various other components not shown in FIG. 2, may include a combination of two or more components, or a division of a particular component into two or more separate components, and still be within the scope of the present invention.

Figure 3:
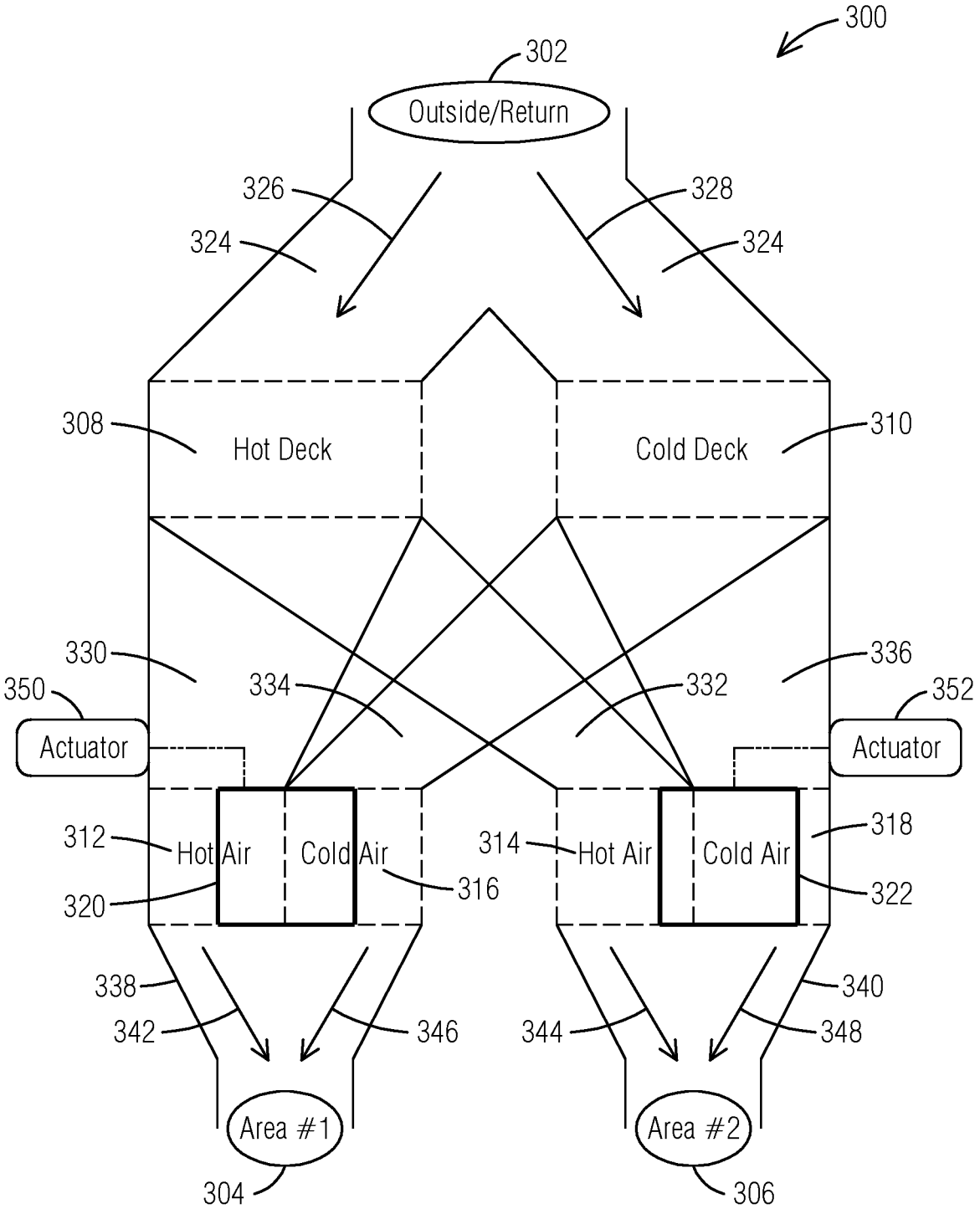
FIG. 3 is a diagrammatic representation of air flow through a multi-zone dual deck configuration of the AHU in an example implementation.

Referring to FIG. 3, there is shown air flow through a multi-zone dual deck configuration 300 of the AHU in an example implementation. For this configuration 300, air flows from an outside or return area 302, such as a ventilation compartment of an RTU, to zone ducts of multiple areas or zones 304, 306. The multi-zone dual deck configuration 300 includes a heating deck 308, a cooling deck 310, and multiple damper apparatus. Each damper apparatus includes a hot air section 312, 314, a cold air section 316, 318, and a damper 320, 322. A frontend duct 324 of the configuration 300 directs the air flow 326, 328 from the outside or return area 302 to the heating deck 308 and the cooling deck 310. A first interim hot air duct 330 directs heated air to the hot air section 312 of a first damper apparatus, and a second interim hot air duct 332 directs heated air to the hot air section 314 of a second damper apparatus. Likewise, a second interim cold air duct 334 directs cooled air to the cold air section 312 of the first damper apparatus, and a second interim cold air duct 336 directs cooled air to the cold air section 314 of the second damper apparatus. First and second zone ducts 338, 340 directs the damper managed air 342-348 from the first and second damper apparatus to the zone ducts of multiple areas or zones 304, 306.

Each damper apparatus is controlled by a control device or, more particularly a processor and output component of the control device. The first damper apparatus includes a first hot air section 312, a first cold air section 316, and a first damper 320, and the second damper apparatus includes a second hot air section 314, a second cold air section 318, and a second damper 322. The first damper 320 is controlled by a first actuator 350, and the second damper 322 is controlled by a second actuator 352. Each of the first and second actuators 350, 352 are controlled by a control device. The processor of the control device determines the location of the damper 320, 322 relative to the hot and cold air sections 312-318 and directs the output component to communicate a change of location, if appropriate, to the actuators 350, 352 of the damper apparatus.

In response to the cooling and heating decks operating together, the control device positions each zone damper 320, 322 associated with the corresponding zone based on the zone demands. In particular, each zone damper 320, 322 is positioned at either a maximum cooling position or a maximum heating position. For the configuration 300 shown in FIG. 3, the maximum cooling position places a particular damper 320, 322 to the far right of the first and second damper apparatus, and the maximum heating position places a particular damper 320, 322 to the far left of the first and second damper apparatus. By restricting the position of the damper 320, 322 to one of these two positions when both decks operate concurrently for this condition, the inefficiency of mixing cool and warm air is minimized.

In response to the cooling and heating decks operating separately, the control device modulates the location of each zone damper 320, 322 associated with the corresponding zone based on the zone demands. In particular, each zone damper 320, 322 may be positioned anywhere between, and including, the maximum cooling and heating positions. Since only one of the two decks is operating for this condition, the damper 320, 322 may be positioned anywhere within this range with minimal concern for inefficiently mixing cool and warm air.

Figure 4A:
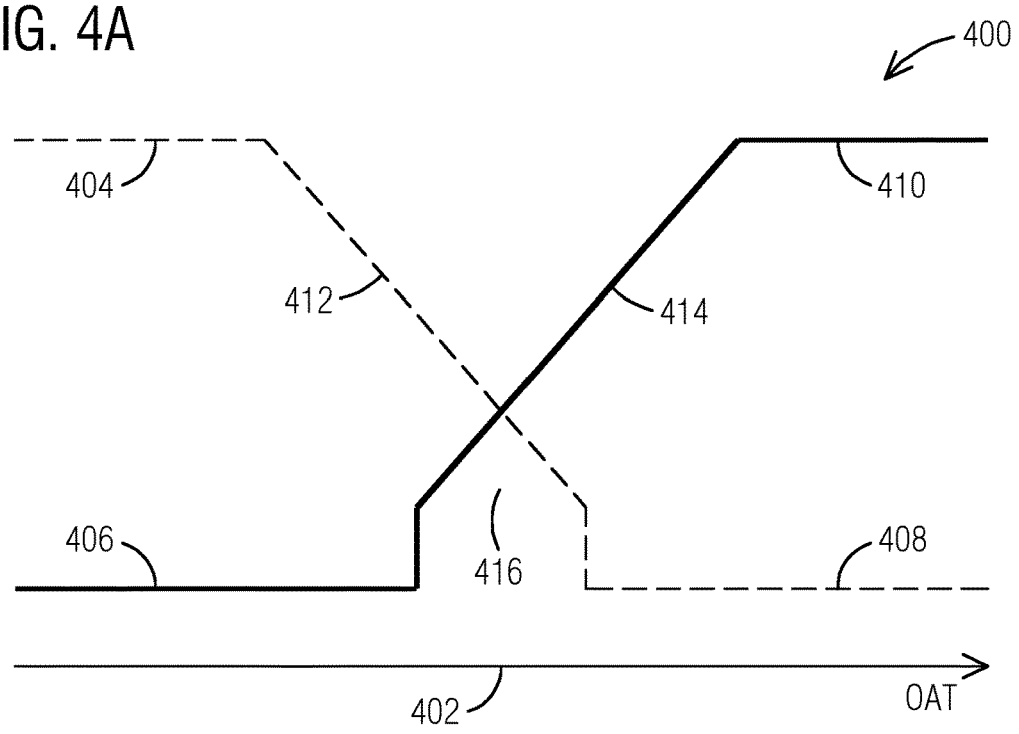
FIGS. 4A and 4B are graphic representations of heating and cooling operations of the AHU in an example implementation.

Referring to FIG. 4A, there are shown a graphic representation of a first heating and cooling operation 400 of the AHU in an example implementation. For this first operation 400, heating and cooling demands change relative to the outside air temperature (OAT) 402. For cool temperatures, a first heating demand 404 may be high and a corresponding first cooling demand 406 may be low. For warm temperatures, a second heating demand 408 may be low and a second cooling demand 410 may be high. As the OAT rises, the zone dampers may be adjusted to reduce 412 heated air and increase 414 cooler air for the zones. Although the first operation 400 provides comfort to occupants of a facility, the efficiency of energy consumption is not optimal since both heating and cooling decks are operating concurrently regardless of the OAT or heating/cooling demand. In addition, there is significant counter-productive mixing 416 of heated air and cooled air for mid-temperatures, which causes substantially wasted consumption of energy. For example, where some zones request warmer temperatures and one or more other zones request cooler temperatures, dampers may be positioned such that air from the heating and cooling decks cancel each other out.

Figure 4B:
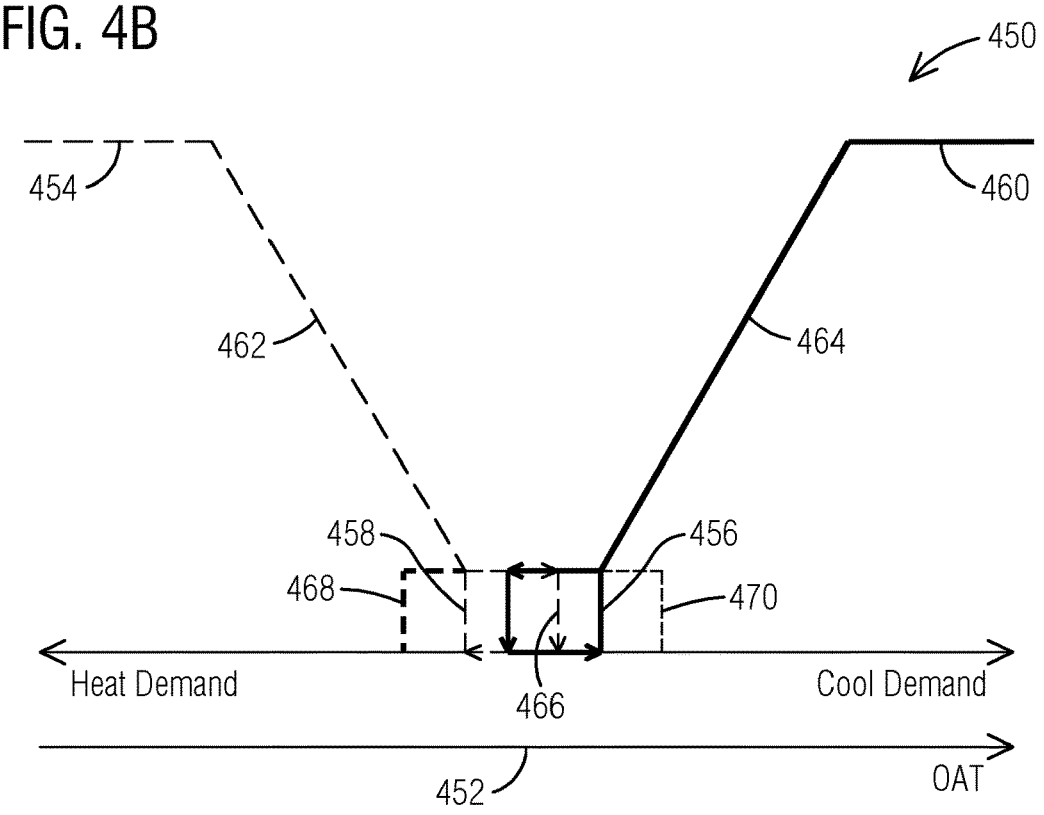

Referring to FIG. 4B, there is shown a graphic representation of a second heating and cooling operation 450 of the AHU in an example implementation that is preferable over the operation shown in FIG. 4A, i.e., in accordance with the multi-zone dual deck system described herein. Like the first operation 400, heating and cooling demands change relative to the outside air temperature (OAT) 452 for this second operation 450. Again, a third heating demand 454 may be high and a third cooling demand 456 may be low for cool temperatures, and a fourth heating demand 458 may be low and a fourth cooling demand 460 may be high. As the OAT rises, the zone dampers may be adjusted to reduce 462 heated air and increase 464 cooler air for the zones.

This second operation 450 provides comfort to occupants of a facility and efficiency of energy consumption to the system. Generally, the heating and cooling decks operate distinctly, in which the heating deck operates during cooler temperatures and the cooling deck operations during warmer temperatures. The mixing 466 of heated air and cooled air is minimized to a limited portion of mid-temperature conditions, a significantly smaller range than the range 468, 470 of mixing 416 of the first operation 400. In addition, during this limited portion of mixing 466 for the second operation 450, the dampers are restricted to operation at either a maximum cooling position or a maximum heating position to further minimize mixing of heated/cooled air and wasting energy.

Figure 5A:
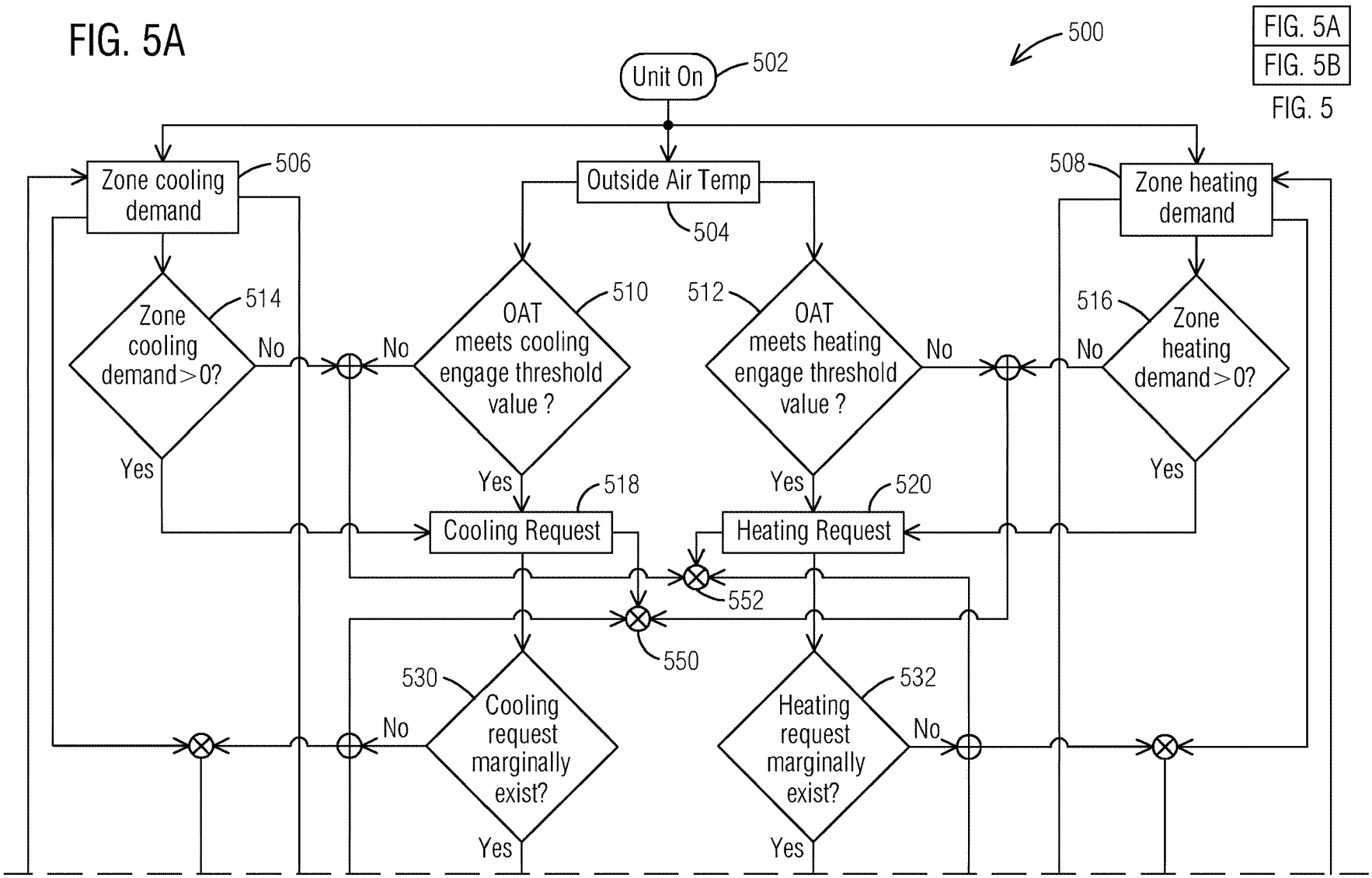
FIG. 5 (including FIGS. 5A and 5B) is a flow diagram representing an operation of the multi-zone dual deck system of the AHU in an example implementation that is operable to employ techniques described herein.
Figure 5B:
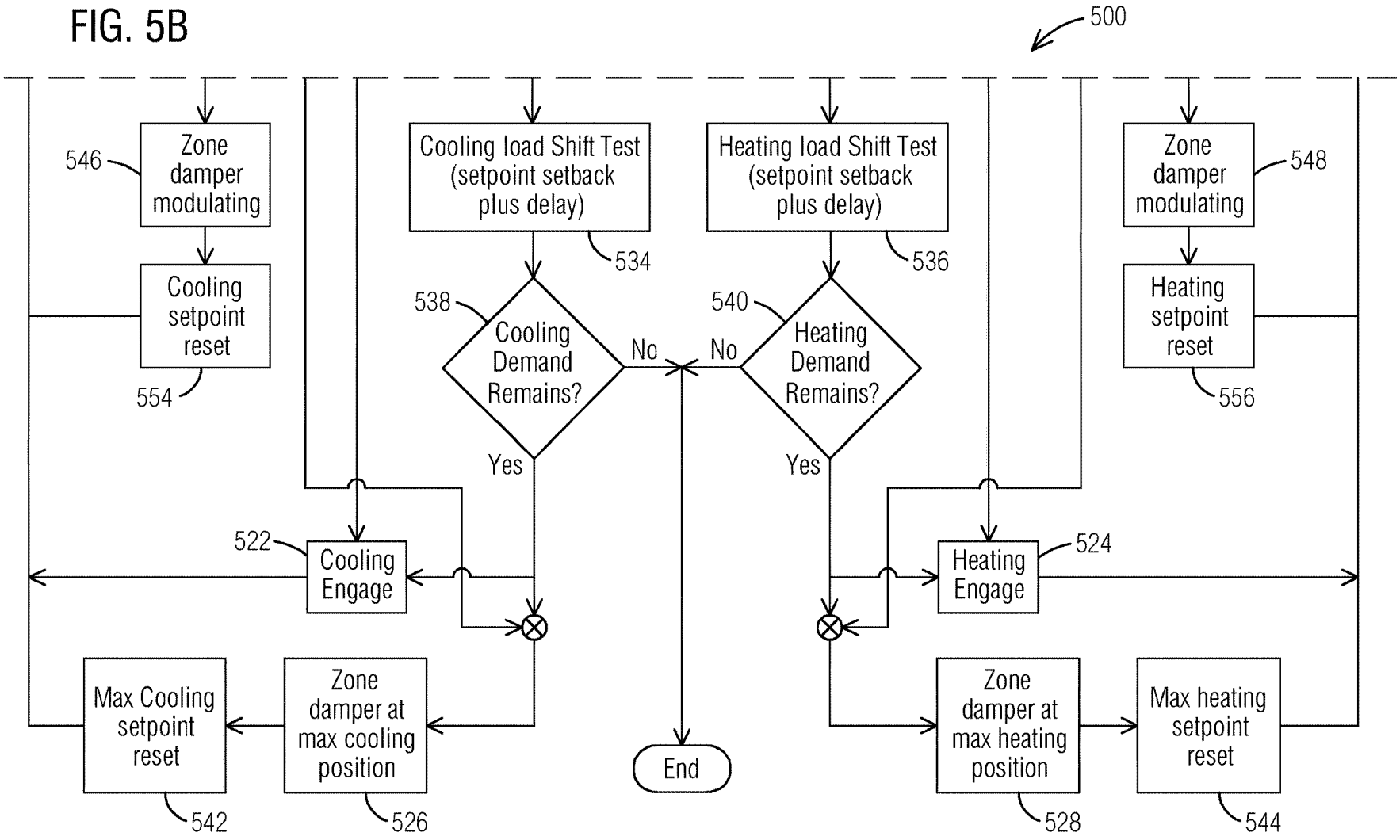

FIG. 5, including FIGS. 5A and 5B, is a flow diagram representing an operation (500) of the multi-zone dual deck system of the AHU in an example implementation that is operable to employ techniques described herein. The system 100 controls the AHU to provide a comfortable environment for occupants of a facility while maintaining an energy efficient operation. The system 100 reduces energy waste by minimizing situations where both heating and cooling functions operate concurrently. When the system 100 operates only the heating function or only the cooling function, then there is no "wash" between the two functions. For those infrequent situations then system 100 operates the heating and cooling functions together, the system reduces the neutralization caused by the concurrent operation of these functions.

The operation (500) is initiated subsequent to activation (502) of the system 100. After activation (502), the system 100 determines at a holistic level whether the heating function and the cooling function need to be operating at the same time. For example, if one zone has a cooling need and all other zones have heating needs, then the one zone is considered to have a small cooling demand. In such case, the system 100 may run the heating function and defer the operation of the cooling function because the environmental conditions may change naturally without engaging the cooling function. Thus, the system 100 determines whether the OAT is within a range that can allow the heating function and/or the cooling function to operate. In addition, the system 100 determines whether either of the zone demands are any zone demands.

The system 100 performs an analysis of the OAT (504) and any received demands (506, 508) to determines whether to engage a cooling function based on the OAT and/or one or more zone cooling demand. Thus, the system 100 engages the cooling deck of the air handling unit, the heating deck of the air handling unit, or both, in response to the outside air temperature (504) and the zone demands (506, 508). For some embodiments, the system 100 may engage the cooling deck, the heating deck, or both decks, in response to the OAT meeting or exceeding (510, 512) a threshold value. For some embodiments, the system 100 may engage the cooling deck in response to receiving (514) one or more zone cooling demands or engage the heating deck response to receiving (516) one or more zone heating demands.

As stated above, the system 100 determines whether to engage (522) the heating function and/or engage (524) the cooling function based on the outside air temperature (OAT) (504) and/or one or more zone conditions (506, 508). The system 100 receives an outside air temperature (504) of the air handling unit, and the system receives zone demands (506, 508) associated with the zones. Each zone demand (506, 508) corresponds to a particular zone of the various zones of the facility. For some embodiments, each zone demand (506, 508) includes a zone cooling demand (506), a zone heating demand (508), or both. For example, one zones of a facility may provide a zone heating demand (506) while another zone may provide a zone cooling demand (508), even though there is only one OAT. As such, the system 100 determines whether one or more zone cooling demands (506) have been received (514) and whether one or more zone heating demands (516) have been received (516). The system 100 generates (518) a cooling request in response to the OAT meeting (510) the cooling threshold and receiving (514) at least one zone cooling demand. The system 100 generates (520) a heating request in response to the OAT meeting (512) the heating threshold and receiving (516) at least one zone heating demand.

The system 100 positions zone dampers associated with the zones based on the zone demands (506, 508) in response to engaging (522) the cooling deck and engaging (524) the heating deck concurrently. Each zone damper of the multiple zone dampers is positioned (526, 528) at either a maximum cooling position or a maximum heating position. For some embodiments, the system 100 positions (526, 528) the zone dampers in response to determining that a delay condition (530-540) of the air handling unit exists. For some embodiments, the system 100 positions (526, 528) the zone dampers in response to determining (530, 532) that a request marginally exists and determining (538, 540) whether a need for the request remains after a delay period. For example, a cooling delay period may correspond to (534) a cooling load shift test including a setpoint setback and delay, and the heating delay period may correspond to (536) a heating load shift test including a setpoint setback and delay. For some embodiments, the system 100 may reset (542) a maximum cooling setpoint associated with the maximum cooling position for at least one zone damper for the primary cooling capacity output of the AHU/RTU or reset (544) a maximum heating setpoint associated with the maximum heating position for at least one zone damper for the primary heating capacity output of the AHU/RTU.

The system 100 modulates (546, 548) the zone dampers associated with the zones based on the demands (506, 508) in response to engaging (522) the cooling deck or engaging (524) the heating deck distinctly. For some embodiments, the system 100 modulates (546, 548) the zone dampers in response to determining (530-540) that a delay condition of the air handling unit does not exist. For some embodiments, the system 100 modulates (546, 548) the zone dampers in response to determining (530, 532) that a cooling or heating request does not marginally exist. For some embodiments, the system 100 modulates the zone dampers in response to receiving no more that one type of zone demand (550, 552). For some embodiments, the system 100 may reset (554) a modulated cooling setpoint for the primary cooling capacity output of the AHU/RTU associated with at least one modulated zone damper or reset (556) a modulated heating setpoint for the primary heating capacity output of the AHU/RTU associated with at least one modulated zone damper.

For those embodiments where the system 100 determines (538, 540) that a need for the request remains after a delay period, the operation 500 may terminate or return to a state of receiving or awaiting receipt of OAT (504) and/or zone demands (506, 508). The operation 500 may also terminate or return to a state of receiving or awaiting receipt of OAT (504) and/or zone demands (506, 508) in response to engaging (522, 524) the cooling and/or heating function, positioning (526, 528) the zone damper(s) and any related tasks, and/or modulating (546) the zone damper(s) and any related tasks.

Those skilled in the art will recognize that, for simplicity and clarity, the full structure and operation of all data processing systems suitable for use with the present disclosure are not being depicted or described herein. Also, none of the various features or processes described herein should be considered essential to any or all embodiments, except as described herein. Various features may be omitted or duplicated in various embodiments. Various processes described may be omitted, repeated, performed sequentially, concurrently, or in a different order. Various features and processes described herein can be combined in still other embodiments as may be described in the claims.

It is important to note that while the disclosure includes a description in the context of a fully functional system, those skilled in the art will appreciate that at least portions of the mechanism of the present disclosure are capable of being distributed in the form of instructions contained within a machine-usable, computer-usable, or computer-readable medium in any of a variety of forms, and that the present disclosure applies equally regardless of the particular type of instruction or signal bearing medium or storage medium utilized to actually carry out the distribution. Examples of machine usable/readable or computer usable/readable mediums include: nonvolatile, hard-coded type mediums such as read only memories (ROMs) or erasable, electrically programmable read only memories (EEPROMs), and user-recordable type mediums such as floppy disks, hard disk drives and compact disk read only memories (CD-ROMs) or digital versatile disks (DVDs).

Although an example embodiment of the present disclosure has been described in detail, those skilled in the art will understand that various changes, substitutions, variations, and improvements disclosed herein may be made without departing from the spirit and scope of the disclosure in its broadest form.

What is claimed is:

1. A system for controlling a multi-zone dual deck air handling unit comprising:

an input component configured to receive an outside air temperature of the air handling unit and a plurality of zone demands associated with a plurality of zones, each zone demand corresponding to a particular zone of the plurality of zones;

an output component configured to communicate with a plurality of zone dampers and at least one of a cooling deck or a heating deck of the air handling unit; and a processor coupled to the input and output components, the processor directing the output component to:

engage at least one of the cooling deck or the heating deck in response to the outside air temperature and the plurality of zone demands;

determine whether a request for heating or cooling marginally exists, perform a load shift test during a delay period, and determine whether a need for the request remains after the delay period;

position the plurality of zone dampers associated with the plurality of zones based on the plurality of zone demands in response to engaging the cooling deck and the heating deck concurrently and determining that the need for the request remains after the delay period, each zone damper of the plurality of zone dampers being position at either a maximum cooling position or a maximum heating position; and modulate the plurality of zone dampers associated with the plurality of zones based on the plurality of zone demands in response to engaging the cooling deck or the heating deck distinctly.

2. The system as described in claim 1, wherein each zone demand including at least one of a zone cooling demand or a zone heating demand.

3. The system as described in claim 1, wherein the processor directs the output component to engage at least one of the cooling deck or the heating deck in response to the outside air temperature meeting or exceeding a threshold value.

4. The system as described in claim 2, wherein the processor directs the output component to engage the cooling deck in response to receiving the zone cooling demand or engage the heating deck in response to receiving the zone heating demand.

5. The system as described in claim 1, wherein the processor directs the output component to modulate the plurality of zone dampers in response to determining that a delay condition of the air handling unit does not exist.

6. The system as described in claim 5, wherein the processor directs the output component to modulate the plurality of zone dampers in response to determining that the request does not marginally exist.

7. The system as described in claim 1, wherein the processor directs the output component to modulate the plurality of zone dampers in response to receiving no more than one type of zone demand.

8. The system as described in claim 1, the processor directs the output component to reset a maximum cooling setpoint associated with either the maximum cooling position or the maximum heating position for at least one zone damper.

9. A method for controlling a multi-zone dual deck air handling unit, the method comprising:

receiving an outside air temperature of the air handling unit;

receiving a plurality of zone demands associated with a plurality of zones, each zone demand corresponding to a particular zone of the plurality of zones;

engaging at least one of a cooling deck or a heating deck of the air handling unit in response to the outside air temperature and the plurality of zone demands;

determining whether a request for heating or cooling marginally exists, performing a load shift test during a delay period, and determining whether a need for the request remains after the delay period;

positioning a plurality of zone dampers associated with the plurality of zones based on the plurality of zone demands in response to engaging the cooling deck and the heating deck concurrently and determining that the need for the request remains after the delay period, each zone damper of the plurality of zone dampers being position at either a maximum cooling position or a maximum heating position; and modulating the plurality of zone dampers associated with the plurality of zones based on the plurality of zone demands in response to engaging the cooling deck or the heating deck distinctly.

10. The method as described in claim 9, wherein each zone demand including at least one of a zone cooling demand or a zone heating demand.

11. The method as described in claim 9, wherein engaging at least one of the cooling deck or the heating deck includes engaging at least one of the cooling deck or the heating deck in response to the outside air temperature meeting or exceeding a threshold value.

12. The method as described in claim 10, wherein engaging at least one of the cooling deck or the heating deck includes at least one of:

engaging the cooling deck in response to receiving the zone cooling demand; or engaging the heating deck in response to receiving the zone heating demand.

13. The method as described in claim 9, wherein modulating the plurality of zone dampers includes modulating the plurality of zone dampers in response to determining that a delay condition of the air handling unit does not exist.

14. The method as described in claim 13, wherein modulating the plurality of zone dampers includes modulating the plurality of zone dampers in response to determining that the request does not marginally exist.

15. The method as described in claim 9, wherein modulating the plurality of zone dampers includes modulating the plurality of zone dampers in response to receiving no more than one type of zone demand.

16. The method as described in claim 9, positioning a plurality of zone dampers includes resetting a maximum cooling setpoint associated with either the maximum cooling position or the maximum heating position for at least one zone damper.

* * * * *